United States Patent [19]

Cochran, Jr. et al.

[11] 4,253,221

[45] Mar. 3, 1981

[54] METHOD OF PRODUCING LOW VOLTAGE FIELD EMISSION CATHODE STRUCTURE

[75] Inventors: Joe K. Cochran, Jr., Marietta, Ga.; Jae-Do Lee, Towanda, Pa.; Alan T. Chapman, Atlanta, Ga.

[73] Assignee: Georgia Tech Research Institute, Atlanta, Ga.

[21] Appl. No.: 48,503

[22] Filed: Jun. 14, 1979

[51] Int. Cl.[3] ..... H01J 9/02; H01J 9/12

[52] U.S. Cl. ..... 29/25.18; 313/309

[58] Field of Search ..... 29/25.17, 25.18; 313/309, 351

[56] References Cited

U.S. PATENT DOCUMENTS

| | | | |
|---|---|---|---|
| 3,789,471 | 2/1974 | Spindt et al. | 357/6 X |
| 3,812,559 | 5/1974 | Spindt et al. | 29/25.18 |
| 3,840,955 | 10/1974 | Hagood et al. | 29/25.18 |
| 4,163,949 | 8/1979 | Shelton | 313/309 |

*Primary Examiner*—Richard B. Lazarus

*Attorney, Agent, or Firm*—Newton, Hopkins & Ormsby

[57] ABSTRACT

A method of making a low voltage field device utilizing a preferentially etched unidirectionally solidified composite as the substrate. In the process, the composite is etched so that the electrically conducting rod-like or fiber phase protrudes above the matrix phase. The tip of the exposed fiber phase may be processed further to provide a rounded or needle-like geometry. Next, a layer of insulating material is deposited in a direction approximately parallel to the axes of the fibers to cause the formation of cone-like deposits of insulating material on the fiber tips which shadow the deposit on the matrix around the fibers and produce conical holes in the layer of insulating material about the fibers. Then, an electrically conductive film is deposited in approximately the same direction to produce on the insulating layer a cellular grid having openings corresponding in number and distribution to the fiber sites. Lastly, the cones of insulating material are removed from the fibers.

10 Claims, 3 Drawing Figures

METHOD OF PRODUCING LOW VOLTAGE FIELD EMISSION CATHODE STRUCTURE

BACKGROUND OF THE INVENTION

The present invention relates to a process for the fabrication of multiple-electrode low voltage field emitting (LVFE) structures. The Government has rights in this invention pursuant to Contract No. DAAK 40-77-C-0096 awarded by U. S. Army Missile R&D Missile Command, Redstone Arsenal, Alabama 35809.

It is well known that electron emission can be stimulated from a variety of sharp pointed conductive materials by a high electric field. Low voltage, high electric field emitting arrays and the methods of producing such devices are disclosed, for example, in U.S. Pat. No. 3,812,559 in the name of Spindt et al and issued on May 28, 1978, U.S. Pat. No. 3,789,471 issued in the name of Spindt et al on Feb. 5, 1974, and U.S. Pat. No. 3,755,704 issued in the name of Spindt et al., on Aug. 28, 1978 all assigned to the Stanford Research Institute. These devices utilize individual needle-like points vapor deposited on a silicon electrode. The major disadvantage of the Stanford Research Institute device is the formation of the field emitting tip from a vapor deposition process resulting in an amorphous or polycrystalline material. In contrast to the Stanford Research Institute device, the procedure disclosed here processes single crystal emitters that are formed and exposed prior to vapor deposition of a thin extractor grid.

BRIEF SUMMARY OF THE INVENTION

Accordingly, it is an object of this invention to provide an improved method of producing low voltage field emission devices.

Briefly in accordance with the invention there is provided a method of making a low voltage field emission device including the step of etching an oxide-metal composite to a desired length to expose the metal fibers. The etching step can produce cylindrical tipped or pointed needle-like fibers or the tip geometry may be alterd so as to be hemispherical by ion milling at this stage of the process. Next, a layer of insulating material is deposited in a direction approximately parallel to the axes of the fibers to cause the formation of inverse-truncated cones of insulating material on the fibers and holes in the layer of insulating material about the fibers. Then, a metal film layer is deposited in the same direction to produce on the insulating layer cellular grid having openings corresponding in number and distribution of the fiber sites. The cones of insulating material are removed from the fibers.

The method of making a low voltage field emission device utilizes in one embodiment single crystal tungsten fibers as the emitters. Since tungsten is the most refractory, highest melting point, and lowest vapor pressure metal known, the emitters are resistant to the failures associated with localized field emitters tip heating and subsequent vaporization. The utilization of this fabrication process with the unidirectionally solidified composites generates an emitter structure with an excess of $10^6$ emitters per $cm^2$. Hence this LVFE structure provides redundancy as well as reducing the current carrying need of the individual emitters to achieve current densities competitive with other structures.

The formation of vapor deposits on protrusions from a substrate in the shape of inverse cones is a unique and fundamental step in this process. The growth of the cones appears to be a newly discovered material property and the cone angles are dependent on the composition of the deposited layer. During deposition, the cones generate self-aligned holes in the surrounding film due to shadowing by the expanding cone and the reproducibility of the LVFE structures is unparalleled compared to prior art methods of generating similar structures. Lastly, a variety of fabrication steps can be used in conjunction with the vapor deposition to yield different emitter and accelerator geometries which may prove beneficial for a variety of high electric field applications. For example, if the cones are removed at an intermediate stage of deposition and the deposition is then continued, new cones will expand from the protrusions while at the same time the holes in the surrounding film will contract toward the protrusions by the same mechanism that causes the cones on the protrusions to expand. When the new cone expands beyond the contracting hole in the surrounding film, shadowing of the surrounding film again occurs and the holes again expand due to shadowing by the cones. This process of removing cones at some intermediate stage of deposition and then continuing deposition is referred to as multiple deposition and has been used to vary the hole diameter independent of the thickness of the deposited film. It should be noted, that film composition may be changed at any time to provide for an extractor or accelerator electrode and that multiple conducting electrodes may be deposited to provide for electron control.

BRIEF DESCRIPTION OF THE DRAWINGS

A more complete appreciation of the invention and many of the attendant advantages thereof will be readily obtained as the same becomes better understood by reference to the following detailed description when considered in conjunction with the accompanying drawings, wherein.

DESCRIPTION OF THE PREFERRED EMBODIMENT

Figure 1:
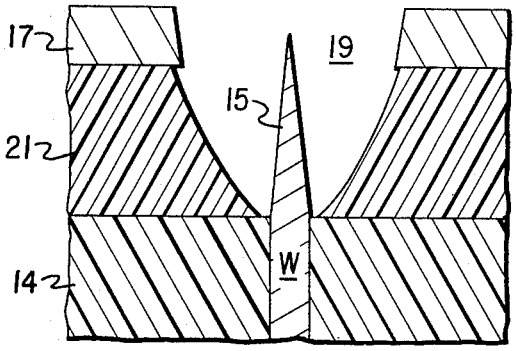
FIG. 1 shows an embodiment of a low voltage field emission device according to the invention.

Referring now to the drawings, wherein like reference numerals designate identical or corresponding parts and more particularly to FIG. 1 thereof, there is shown a low voltage field emission device in accordance with the invention. The structure includes a matrix 14 in which a large number of needle-like conducting electrodes 15 called emitters are distributed with a high packing density. A surface called the accelerator or extractor 17 is the electrode used to produce the field. It consists of a conducting film supported by the electric insulator 21 normal to the axes of the emitters 15. Holes 19 extending through the accelerator 17 into the electric insulator 21 are provided to expose the tip of an emitter 15 at each hole location. Upon application of a potential between the emitters 15 and the accelerator 17 surface, an electric field is established between the tips of the emitters and the accelerator which is of polarity to cause electrons to be emitted from the emitter tips through the holes 19 in the accelerator. The field emission device has a simple structure. The rim of the hole in the accelerator is positioned at an extremely short distance from the tip of the emitter. As a result of this, a strong electric field can be generated with a comparatively low voltage difference.

Figure 2:
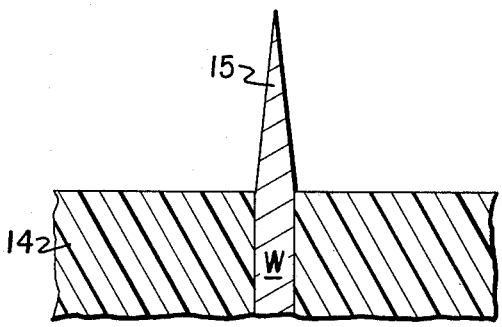
FIG. 2 shows a $UO_2$-W composite after etching to produce free-standing emitters.
Figure 3:
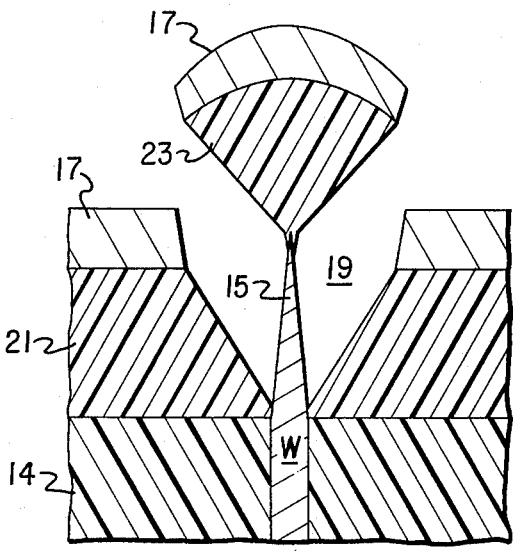
FIG. 3 shows the assembly shown in FIG. 2 after an insulating layer and an electrically conductive film have been vapor-deposited thereon.

FIGS. 2 and 3 show successively steps in the manufacture of the low voltage field emission device. In this case also a specific embodiment is described, in which, for example, variations are possible in the material choice and the treatments to be carried out. FIG. 2 shows an oxide-metal composite consisting of an oxide matrix 14 containing a plurality of unidirectionally aligned metallic fibers 15. Free standing emitters 15 are formed by etching the oxide matrix 14 to a desired depth. The composite can be fabricated by well-known prior art techniques. One fabrication approach which can be utilized is described in detail in the publication "Report No. 6: Melt Grown Oxide-Metal Composites" from the School of Ceramic Engineering, Georgia Institute of Technology, A. T. Chapman, Project Director (December 1973) hereby incorporated by reference, detailing fabrication of a melt grown oxide-metal composite consisting of about $10^7$ parallel metal fibers in each square centimeter of an oxide matrix. Preferred materials are single crystal W or Mo for the fibers, and $UO_2$ for the oxide matrix, but other well-known materials can be utilized. The composite is grown in an induction furnace from a mix of oxide and of metal powders. Auxiliary heating brings the oxide-metal sample ingot close to the melting point. Induction heating melts a zone in the interior of the ingot but does not melt the outside of the ingot. The outer unmelted zone of the ingot acts as a crucible to contain the melt. Unidirectional solidification of the molten internal zone is accomplished by moving the zone up through the ingot. During solidification the metal precipitates to form small ($<1\mu m$ diameter) fibers regularly arrayed and aligned in the oxide matrix.

Next, the unidirectional composite is processed to produce metal conductors protruding above the matrix. For the system $UO_2$-W, etches are available that dissolve the $UO_2$ matrix without dissolving the W which produces W fibers with cylindrical tips above the matrix. There are also etchs which dissolve the $UO_2$ matrix and slowly attack the W fibers. This produces W fibers with pointed tips above the $UO_2$ matrix. The tip shape can also be altered by ion milling the exposed fibers. Ion milling of exposed cylindrical tipped fibers produces a variety of tip geometries from cylindrical tips with rounded corners to hemispherical tips to pointed tips.

After formation of the emitters 15, the support structure for the accelerator 17 is produced. Namely, an insulating layer 21 made of $SiO_2$ film or $Al_2O_3$ film is deposited at normal incidence on the oxide matrix 14, that is, roughly parallel to the axes of the fibers 15, by the well-known vapor deposition method. The insulating layer 21 forms deposits on the electrodes in the shape of inverse truncated cones 23 having cone angles of from 30 to 90 degrees. The cones 23 in turn act as masks for annular regions which are concentric with the electrodes, so that during the deposition process, each electrode stands free within a gradually expanding opening 19 in the insulating layer 21. When the insulating layer reaches a desired thickness the deposition is terminated. The accelerator 17 is then formed by depositing a conducting film such as Mo on the insulating layer 21 at normal incidence thereto so as to produce a cellular grid whose openings correspond in number and distribution to the emitter 15 sites. The unit thus formed is shown in FIG. 3.

Next, the structure is utlrasonically vibrated in a liquid such as water, which satisfactorily removes the cones 23 from the emitters 15. Alternatively, the cones may be removed by chemically attacking the insulator portion of the cones 23. Following cone removal, the structure is cleaned by etching in a variety of acids depending on the composition of the insulating and conducting layers.

The structure illustrated and thus far described was tested electrically with the following results. For a structure utilizing W emitters and an Mo accelerator, current densities of 1 ampere per $cm^2$ were achieved when a pulsed potential of 200 volts was applied between the emitters and the accelerator surface. If the emitters are conservatively operated at 10 microamperes per emitter, a current density of 100 ampere per $cm^2$ should be obtained.

In an alternate embodiment, as described previously, multiple depositions of insulating layers and removal of the cones at intermediate periods can be used to control the diameter of the holes 1 surrounding the individual emitters 15.

Obviously, numerous additional modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A method of making a low voltage field emission device comprising the steps of:

providing an oxide-metal composite which consists of a plurality of metallic fibers unidirectionally aligned in an oxide matrix;

etching the oxide matrix to a desired depth to expose the fibers;

forming a needle-like tip on the fibers;

depositing in a direction approximately parallel to the axes of the fibers a layer of insulating material on the oxide matrix to cause the formation of inverse truncated cones of insulating material on the fibers and holes in the layer of insulating material about the fibers;

depositing in a direction approximately parallel to the axes of the fibers a metal film on the insulating layer and the insulating cones to produce a cellular grid whose openings correspond in number and distribution to the sites of the fibers; and removing the cones of insulating material from the fibers.

2. The method of making a low voltage field emission device recited in claim 1 wherein the providing step includes:

providing an oxide-metal composite which consists of a plurality of single crystal W metallic fibers undirectionally aligned in an oxide matrix.

3. The method of making a low voltage field emission device recited in claim 1 wherein the providing step includes:

providing an oxide-metal composite which consists of a plurality of single crystal Mo metallic fibers unidirectionally aligned in an oxide matrix.

4. The method of making a low voltage field emission device recited in claim 1 wherein the providing step includes:

providing an oxide-metal composite which consists of a plurality of metallic fibers unidirectionally aligned in an $UO_2$ matrix.

5. The method of making a low voltage field emission device recited in claim 1 wherein the providing step includes:

providing a unidirectionally solidified insitu composite which consists of a plurality of electrically conducting fibers unidirectionally aligned in a matrix.

6. The method of making a low voltage field emission device recited in claim 1 wherein the insulating material depositing step includes:

depositing in a direction approximately parallel to the axes of emitters exposed above a matrix a layer of electrically insulating material to cause the formation of inverse truncated cones of insulating material on the emitters and holes about the emitters in the layer of insulating material on the matrix.

7. The method of making a low voltage field emission device recited in claim 1 wherein the insulating material depositing step includes:

depositing in a direction approximately parallel to the axes of the fibers a layer of $Al_2O_3$ or $SiO_2$ insulating material on the matrix to cause the formation of inverse truncated cones of insulating material on the fibers and holes in the layer of insulating material about the fibers.

8. The method of making a low voltage field emission device recited in claim 1 wherein the metal film depositing step includes:

depositing in a direction parallel to the axes of the fibers a Mo metal film on the insulating layer to produce a cellular grid whose openings correspond in number and distribution to the sites of the fibers.

9. The method of making a low voltage field emission device recited in claim 1 wherein the removing step includes the step of:

ultrasonically vibrating the oxide-metal composite to remove the vapor deposited cones of insulating material from the fibers.

10. The method of making a low voltage field emission device recited in claim 1 wherein the step of forming includes the step of:

ion milling the fibers to form a needle-like tip thereon.

* * * * *

UNITED STATES PATENT AND TRADEMARK OFFICE

CERTIFICATE OF CORRECTION

PATENT NO. : 4,253,221

DATED : March 3, 1981

INVENTOR(S) : Joe K. Cochran, Jr. et al.

It is certified that error appears in the above—identified patent and that said Letters Patent is hereby corrected as shown below:

On the title page in item [75] the following should be added:

-- David Norman Hill,
Atlanta, Ga. --.

Signed and Sealed this

*Second* Day of *June 1981*

[SEAL]

*Attest:*

RENE D. TEGTMEYER

*Attesting Officer*

*Acting Commissioner of Patents and Trademarks*